US008482471B2

(12) United States Patent
Su

(10) Patent No.: US 8,482,471 B2
(45) Date of Patent: Jul. 9, 2013

(54) HYBRID MULTIPLE-INPUT MULTIPLE-OUTPUT ANTENNA MODULE AND SYSTEM OF USING THE SAME

(75) Inventor: Saou-Wen Su, Keelung (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 284 days.

(21) Appl. No.: 13/004,977

(22) Filed: Jan. 12, 2011

(65) Prior Publication Data

US 2011/0241953 A1 Oct. 6, 2011

(30) Foreign Application Priority Data

Apr. 2, 2010 (CN) ..... 2010 2 0176740 U

(51) Int. Cl.
*H01Q 11/12* (2006.01)
*H01Q 1/38* (2006.01)

(52) U.S. Cl.
USPC ..... 343/742; 343/700 MS; 343/728; 343/848; 343/893

(58) Field of Classification Search
None
See application file for complete search history.

(56) References Cited

U.S. PATENT DOCUMENTS

| | | | | |
|---|---|---|---|---|
| 6,819,291 | B1 * | 11/2004 | Lackey et al. | 343/700 MS |
| 7,170,449 | B2 * | 1/2007 | Eide | 343/700 MS |
| 7,215,296 | B2 * | 5/2007 | Abramov et al. | 343/834 |
| 7,427,955 | B2 * | 9/2008 | Choi et al. | 343/700 MS |
| 8,159,398 | B2 * | 4/2012 | Su | 343/700 MS |
| 8,269,682 | B2 * | 9/2012 | Su | 343/742 |
| 2010/0060543 | A1 * | 3/2010 | Fonseca et al. | 343/848 |
| 2011/0090129 | A1 * | 4/2011 | Weily et al. | 343/770 |

* cited by examiner

*Primary Examiner* — Trinh Dinh
(74) *Attorney, Agent, or Firm* — Rabin & Berdo, P.C.

(57) ABSTRACT

The hybrid multiple-input multiple-output antenna module includes a grounding unit, a plurality of radiating units, loop units and filter units. The radiating units and the loop units are arranged around a geometric center of the grounding unit and are alternately and symmetrically arranged on the grounding unit. The loop units are arranged along the outer peripheral side of the grounding unit. The filter units are respectively electrically connected to the loop units. The present invention not only has some advantages such as small size, low profile, good isolation, high antenna gain and good radiation properties, but also can replace the external dual-band access-point antenna of the prior art for 2.4/5 GHz operation with no need of an extra diplexer. In addition, the hybrid multiple-input multiple-output antenna module can be hidden in the wireless communication device in order to enhance the appearance of the product.

20 Claims, 8 Drawing Sheets

HYBRID MULTIPLE-INPUT MULTIPLE-OUTPUT ANTENNA MODULE AND SYSTEM OF USING THE SAME

RELATED APPLICATIONS

This application claims priority under 35 U.S.C. 119 from CHINA Application Number 201020176740.8 filed on Apr. 2, 2010, the contents of which are incorporated herein by references.

BACKGROUND OF THE INVENTION

1. Field of the Invention

The present invention relates to a multiple-input multiple-output antenna module, and more particularly, to a hybrid multiple-input multiple-output antenna module and a system of using the same.

2. Description of Related Art

The wireless LAN or 802.11a/b/g/n access-point antenna of the related art is almost of an external antenna structure. Common dipole antennas have a plastic or rubber sleeve covering thereon. In general, the dipole antenna is a single-band antenna for 2.4 GHz operation or a dual-band single-radio antenna for 2.4/5 GHz operation. The height of the dipole antenna is triple the thickness of the wireless broadband router/hub device, and one part of the dipole antenna is arranged on a side of the router and the rest of the dipole antenna is protruding from the top of the access-point or router enclosure. However, the protruded part of the dipole antenna can easily be vandalized by an outside force and also occupies space, which deteriorates the aesthetic appeal of the product, especially for the multi-antenna system.

Conventional dual-band single-radio antenna applied to 2.4/5 GHz wireless LAN or 802.11a/b/g/n has only one RF signal feeding port, thus two conductive copper tubes and an extra diplexer need to be used in order to achieve 2.4/5 GHz concurrent dual-band operation. However, the cost would be increased and the whole system loses extra gain or power due to the design of the conventional dual-band single-radio antenna.

Moreover, the related art provides another dual-band cross polarization dipole antenna that discloses a dual-antenna system. The dual-antenna system has two dual-band dipole antennas to generate two frequency bands for 2.4/5 GHz operation. However, the dual-antenna structure is of a stacked structure, thus the height of the whole antenna structure is high.

Furthermore, the enterprise access-point antenna or the router is usually installed on a ceiling. Thus, the downlink and uplink qualities would be directly affected by the antennas radiation-pattern coverage. Because the operating frequencies in 5 GHz band are larger than the operating frequencies in 2.4 GHz band, the path loss of a 5 GHz antenna is larger than the path loss of a 2.4 GHz antenna. Therefore, the gain of a 5 GHz antenna needs to be larger in order to compensate high path loss in 5 GHz band.

SUMMARY OF THE INVENTION

One particular aspect of the present invention is to provide a hybrid multiple-input multiple-output antenna module and a system of using the same. The present invention not only has some advantages such as small size, low profile, good isolation, high antenna gain and good radiation properties, but also can replace the external dual-band access-point antennas of the prior art for 2.4/5 GHz operation with no need of extra diplexers. In addition, the hybrid multiple-input multiple-output antenna module can be hidden in the wireless communication device in order to enhance the appearance of the product.

In order to achieve the above-mentioned aspects, the present invention provides a hybrid multiple-input multiple-output antenna module, including: a grounding unit, a plurality of radiating units, loop units and filter units. The radiating units are mounted on the grounding unit. The loop units are arranged along the outer peripheral side of the grounding unit and vertically arranged on the grounding unit. The filter units are arranged on the grounding unit and respectively electrically connected to the second feeding pins of the loop units. The radiating units and the loop units are arranged around a geometric center of the grounding unit and are alternately and symmetrically arranged on the grounding unit.

In order to further understand the techniques, means and effects the present invention takes for achieving the prescribed objectives, the following detailed descriptions and appended drawings are hereby referred, such that, through which, the purposes, features and aspects of the present invention can be thoroughly and concretely appreciated; however, the appended drawings are provided solely for reference and illustration, without any intention that they be used for limiting the present invention.

DETAILED DESCRIPTION OF THE PREFERRED EMBODIMENTS

Figure 1A:
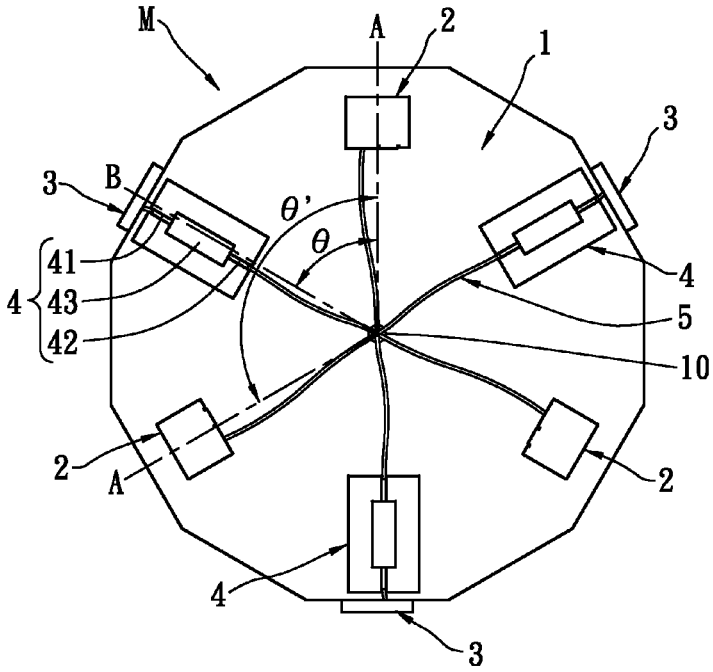
FIG. 1A is a top, schematic view of the first embodiment of the present invention.

Referring to 1A to 1D, the first embodiment of the present invention provides a hybrid multiple-input multiple-output antenna module M, including: a grounding unit 1, a plurality of radiating units 2, a plurality of loop units 3 and a plurality of filter units 4. In addition, the grounding unit 1 and the loop units 3 may be integrally combined to form a one-piece plate structure. Of course, the loop units 3 may be manufactured respectively, and then the finished loop units 3 are arranged along the outer peripheral side of the finished grounding unit 1.

The radiating units 2 and the loop units 3 are arranged around a geometric center of the grounding unit 1, and the radiating units 2 and the loop units 3 are alternately and symmetrically arranged on the grounding unit 1. Each radiating unit 2 has a geometric centerline A (the geometric centerline A connects to the geometric center of the grounding unit 1) and each loop unit 3 has a geometric centerline B (the geometric centerline B connects to the geometric center of the grounding unit 1), and every two adjacent geometric centerlines (A, B) and the loop unit 3 intersect at the geometric center of the grounding unit 1 to form an included angle θ and each of the included angles θ has substantially the same measure. In addition, two geometric centerlines A of every two adjacent radiating units 2 (or every two adjacent loop units 3) intersect at the geometric center of the grounding unit 1 to form an included angle θ' and each of the included angles θ' has substantially the same measure.

For example, the numbers of the radiating units 2 and the loop units 3 are three, thus each included angle θ is 60 degrees and each included angle θ' is 120 degrees (as shown in FIG. 1A).

Moreover, the grounding unit 1 may be a regular polygonal conductive plate, a circular conductive plate or any conductive plates with a predetermined shape. The first embodiment shows the regular polygonal conductive plate as an example, and the grounding unit 1 has a through hole 10 passing through a central portion thereof. In addition, the hybrid multiple-input multiple-output antenna module M further includes a plurality of signal transmission lines 5. One end of the each signal transmission line 5 is electrically connected to the radiating unit 2 or the loop unit 3, and another end of the signal transmission line 5 passes through the through hole 10, thus the signal transmission lines 5 may be routed neatly by passing through the through hole 10. Furthermore, antenna signals received by the radiating units 2 or the loop units 3 may be transmitted to wireless device system PCB (not shown) of a router by using the signal transmission lines 5. Of course, the present invention can omit the through hole 10, thus the signal transmission lines 5 may be attached to the top surface of the grounding unit 1 in order to facilitate the cable routing for the signal transmission lines 5.

Figure 1B:
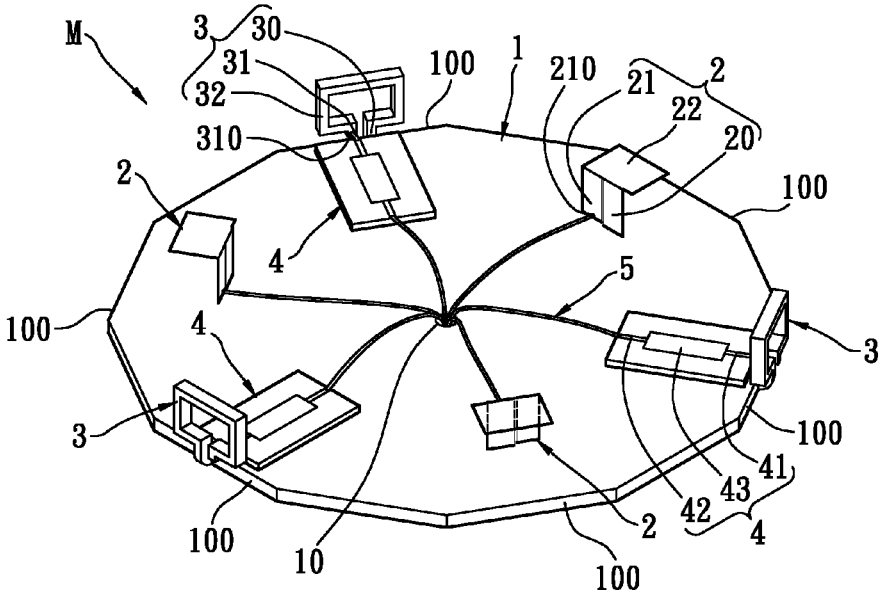
FIG. 1B is a perspective, schematic view of the first embodiment of the present invention.
Figure 1C:
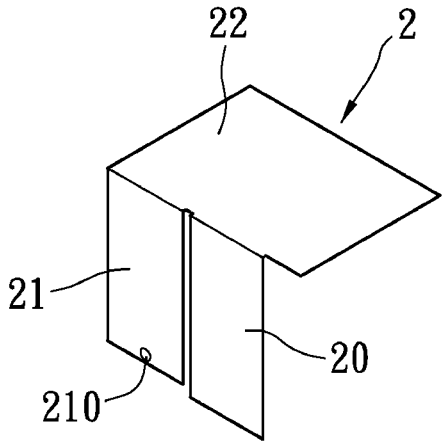
FIG. 1C is a perspective, schematic view of one radiating unit according to the first embodiment of the present invention.

Referring to FIGS. 1B and 1C, the radiating units 2 are arranged on the grounding unit 1 and are separated from the outer peripheral sides 100 of the grounding unit 1 by a predetermined distance. Each radiating unit 2 has a first radiating body 22 parallel to the surface of the grounding unit 1 and extended towards outer peripheral side 100 of the grounding unit 1, at least one first feeding pin 21 having a first feeding point 210 on a bottom portion thereof being extended downwards from one side of the first radiating body 22 and being suspended above the grounding unit 1 at a predetermined distance, and at least one first shorting pin 20 being extended downwards from one side of the first radiating body 22 and being connected to the grounding unit 1. In addition, both the first feeding pin 21 and the first shorting pin 20 are coplanar, and both the first feeding pin 21 and the first shorting pin 20 and the radiating body 22 are non-coplanar.

Figure 1D:
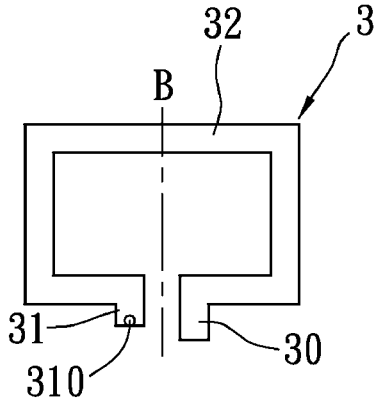
FIG. 1D is a front, schematic view of one loop unit according to the first embodiment of the present invention.

Referring to FIGS. 1B and 1D, the loop units 3 are arranged along the outer peripheral sides 100 of the grounding unit 1 and vertically arranged on the grounding unit 1. Each loop unit 3 has at least one second shorting pin 30 mounted on the grounding unit 1, at least one second feeding pin 31 having a second feeding point 310 on a bottom portion thereof separated from the second shorting pin 30 by a predetermined distance and suspended above the grounding unit 1 at a predetermined distance, and at least one second radiating body 32 vertically suspended above the grounding unit 1 at a predetermined distance and connected between the second shorting pin 30 and the second feeding pin 31. Referring to FIG. 1D, the second shorting pin 30 and the second feeding pin 31 of each loop unit 3 are symmetrically arranged beside two sides (left direction and right direction) of the geometric centerline B of each loop unit 3. In addition, the second radiating body 32, the second feeding pin 31 and the second shorting pin 30 are coplanar.

The filter units 4 are arranged on the grounding unit 1 and parallelly attached to the surface of the grounding unit 1, and the filter units 4 are respectively electrically connected to the second feeding pins 31 of the loop units 3 for filtering particular transmission signal. Each filter unit 4 has a first transmission section 41, a second transmission section 42 and a microwave printed filter 43 connected between the first transmission section 41 and the second transmission section 42. One end of the first transmission section 41 of each filter unit 4 is electrically connected to the second feeding pin 31 of each loop unit 3 and one end of the second transmission section 42 of each filter unit 4 is electrically connected to a signal transmission line 5. Each filter unit 4 may be a band-stop filter for restraining half-wavelength resonant mode of each loop unit 3, in which the half-wavelength resonant mode of each loop unit 3 is close to the antenna operating frequencies of each radiating unit 2. For example, the antenna operating frequencies of each radiating unit 2 may be 2.4 GHz, the antenna operating frequencies of each loop unit 3 may be 5 GHz, each filter unit 4 may be a 2.4 GHz printed microstrip band-stop filter electrically connected to a second feeding point 310 of each loop unit 3 (such as a 5 GHz loop antenna) for restraining half-wavelength resonant mode of 5 GHz loop antenna, in which the half-wavelength resonant mode of 5 GHz loop antenna is close to 2.4 GHz operating frequencies band. Therefore, the isolation for 2.4 GHz operation between 2.4 GHz antenna and 5 GHz antenna would be decreased because the two antennas do not have the overlapped operating frequencies of the nearby resonant modes.

Furthermore, the radiating units 2 and the loop units 3 have some different design aspects according to different design requirements, as follows:

1. Referring to FIG. 1B, looking at any one radiating unit 2, the first feeding pin 21 is adjacent to the second shorting pin 30 that is arranged beside the left side, and the first shorting pin 20 is adjacent to the second feeding pin 31 that is arranged beside the right side. The above-mentioned alternate-antenna design can prevent the first feeding pins 21 and the second feeding pins 31 from being coupled with each other and prevent the first shorting pins 20 and the second shorting pins 30 from being coupled with each other. Therefore, the mutual coupling between each radiating unit 2 with first antenna operating frequencies (first frequency band) and each loop unit 3 with second antenna operating frequencies (second frequency band) is substantially decreased and the isolation can be remained under at least −20 dB.

2. Referring to FIGS. 1C and 1D, the first shorting pin 20 and the first feeding pin 21 of each radiating unit 2 are separated from each other by a predetermined distance, and the second shorting pin 30 and the second feeding pin 31 of each loop unit 3 are separated from each other by a predetermined distance, in order to obtain good impedance matching. In addition, a designer can adjust the above-mentioned predetermined distances in order to change antenna operating frequencies according to different design requirements. In addition, the heights of each radiating unit 2 and each loop unit 3 relative to the grounding unit 1 also may be adjusted according to different antenna performance (such as antenna radiation patterns and antenna gain) that a designer wants.

Therefore, the hybrid multiple-input multiple-output antenna module M can obtain good impedance matching (defined by 2:1 VSWR or 10 dB return loss) for WLAN operation in the 2.4/5 GHz bands by adjusting (1) the distance between the first shorting pin 20 and the first feeding pin 21 of each radiating unit 2, (2) the distance between the second shorting pin 30 and the second feeding pin 31 of each loop unit 3, and (3) the height of each radiating unit 2 and the height of each loop unit 3 relative to the grounding unit 1.

3. Referring to FIGS. 1B to 1D, the first feeding points 210 and the second feeding points 310 face the geometric center of the grounding unit 1. In addition, the distance between each first feeding point 210 and the geometric center of the grounding unit 1 may be different from the distance between each second feeding point 310 and the geometric center of the grounding unit 1, but the distance between any one of feeding points with the same operating frequencies or the loop unit 3 and the geometric center of the grounding unit 1 is the same.

Moreover, the signal transmission lines 5 are respectively connected to the first feeding points 210 of the first feeding pins 21 and the second feeding points 310 of the second feeding pins 31 through the filter units 4. Hence, antenna signals received by the radiating units 2 or the loop units 3 may be transmitted to wireless device system PCB of a router by using the signal transmission lines 5.

4. Referring to FIGS. 1A and 1B, the first shorting pin 20 and the first feeding pin 21 of each radiating unit 2 are formed on the same plane and both the first shorting pin 20 and the first feeding pin 21 are approximately vertical to the first radiating body 22. In addition, the second shorting pin 30, the second feeding pin 31 and the second radiating body 32 of each loop unit 3 are formed on the same plane or curved surface.

5. The antenna operating frequencies of the radiating units 2 are the same (such as antenna lower frequency band), and the antenna operating frequencies of the loop units 3 are the same (such as antenna higher frequency band). For example, the antenna operating frequencies of each radiating unit 2 may be in 2.4 GHz band, and the antenna operating frequencies of each loop unit 3 may be in 5 GHz band.

Furthermore, the structures of the radiating units 2 and the loop units 3 in the above-mentioned five different design aspects are an example. FIG. 1A shows three radiating units 2, the topmost one of the three radiating units 2 is defined as a first one (label S1) of the three radiating units 2, another radiating unit 2 arranged at the lower left-hand corner is defined as a second one (label S2) of the three radiating units 2, and the other radiating unit 2 arranged at the lower right-hand corner is defined as a third one (label S3) of the three radiating units 2. FIG. 1A shows three loop units 3, one loop unit 3 arranged at the upper right-hand corner is defined as a first one (label S4) of the three loop units 3, another loop unit 3 arranged at the upper left-hand corner is defined as a second one (label S5) of the three loop units 3, and the bottommost one of the three loop units 3 is defined as a third one (label S6) of the three loop units 3.

Figure 1E:
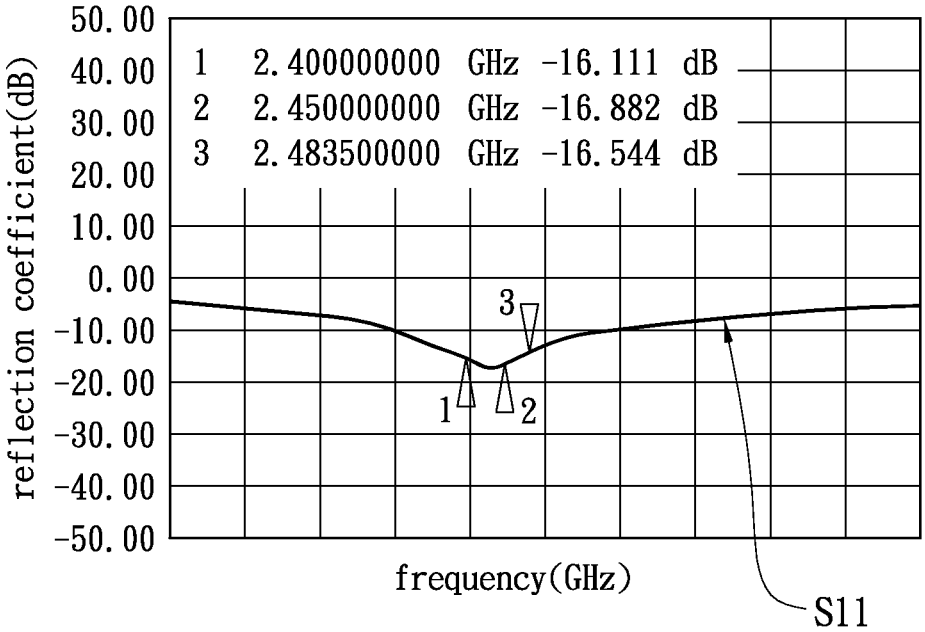
FIG. 1E is a curve diagram of the reflection coefficients (S parameters (dB)) of the first radiating unit against frequencies (MHz) according to the first embodiment of the present invention.

Referring to FIGS. 1A and 1E, FIG. 1E shows reflection coefficients (S parameters (dB)) of the radiating units 2 such as the curve in FIG. 1E) against frequencies (MHz) according to the test results of the radiating units 2. Referring to the three frequency points (1, 2 and 3) labeled in FIG. 1E, the reflection coefficients in 2.4 GHz band are below −10 dB.

Figure 1F:
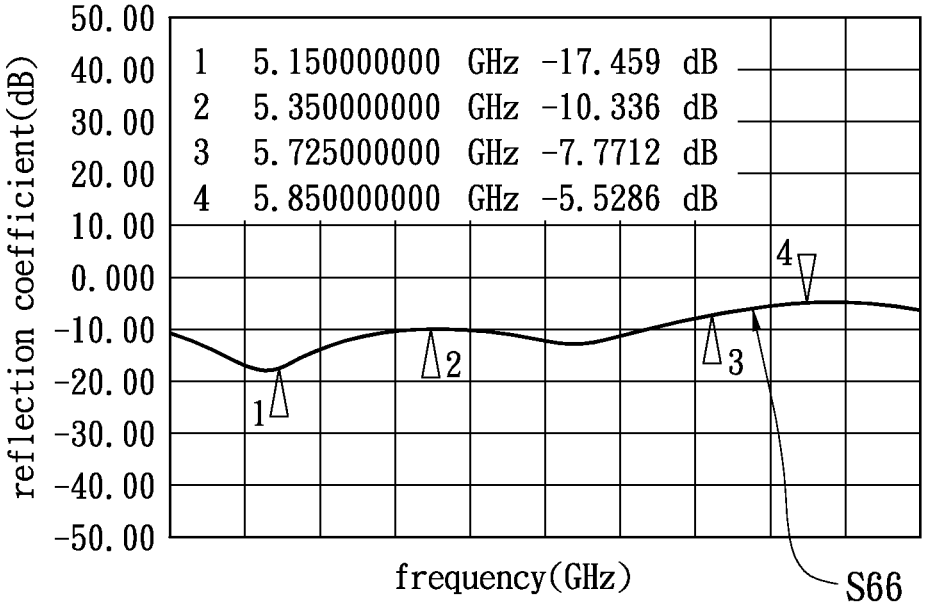
FIG. 1F is a curve diagram of the reflection coefficients of the third loop unit against frequencies according to the first embodiment of the present invention.

Referring to FIGS. 1A and 1F, FIG. 1F shows reflection coefficients (S parameters (dB)) of the loop units 3 such as the curve in FIG. 1F) against frequencies (MHz) according to the test results of the loop units 3. The reflection coefficients in 5 GHz band are below −7.3 dB according to the four frequency points (1, 2, 3 and 4) labeled in FIG. 1F.

Figure 1G:
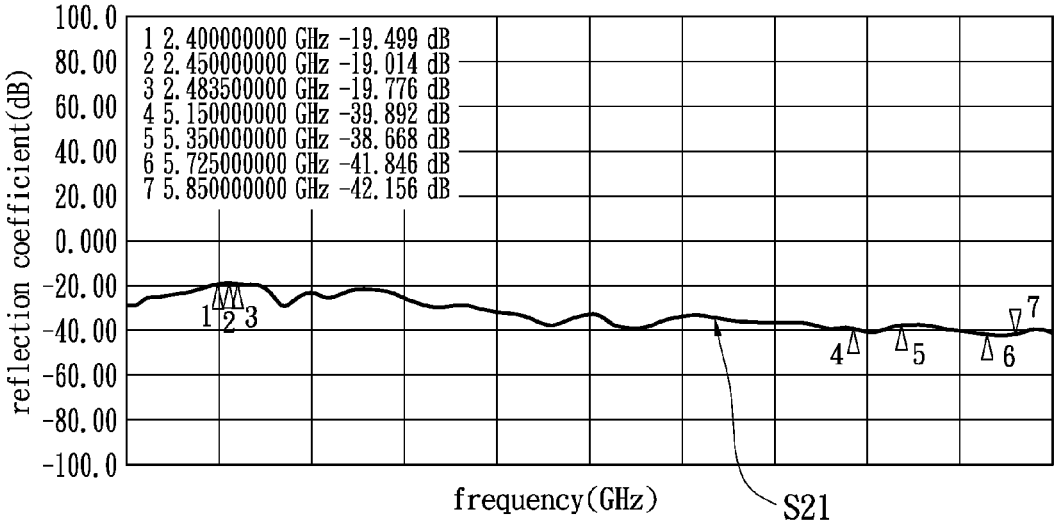
FIG. 1G is a curve diagram of the isolation between the second radiating unit and the first radiating unit against frequencies according to the present invention.
Figure 1H:
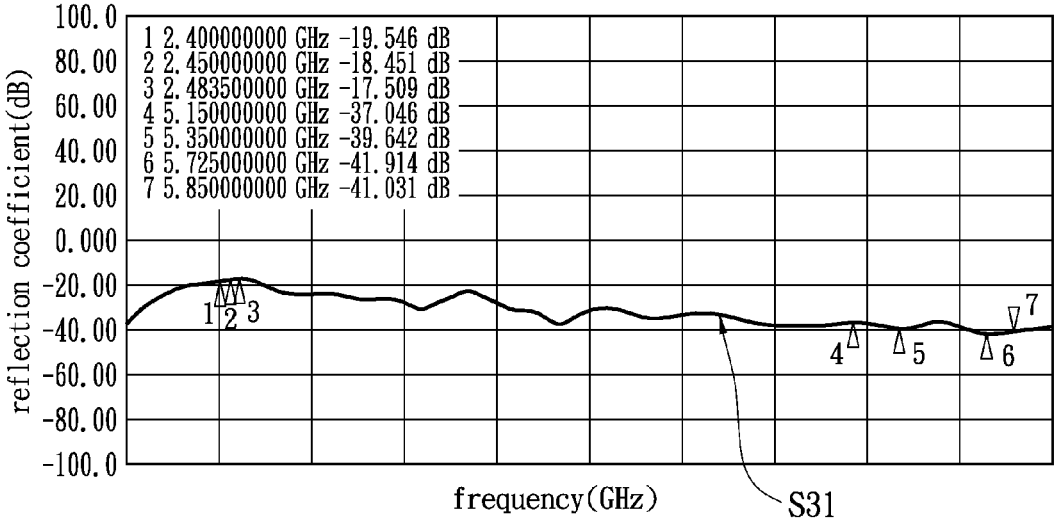
FIG. 1H is a curve diagram of the isolation between the third radiating unit and the first radiating unit against frequencies according to the present invention.
Figure 1I:
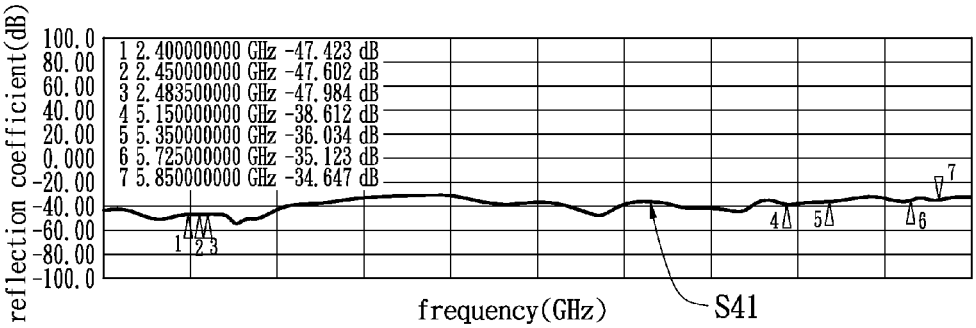
FIG. 1I is a curve diagram of the isolation between the first loop unit and the first radiating unit against frequencies according to the present invention.
Figure 1J:
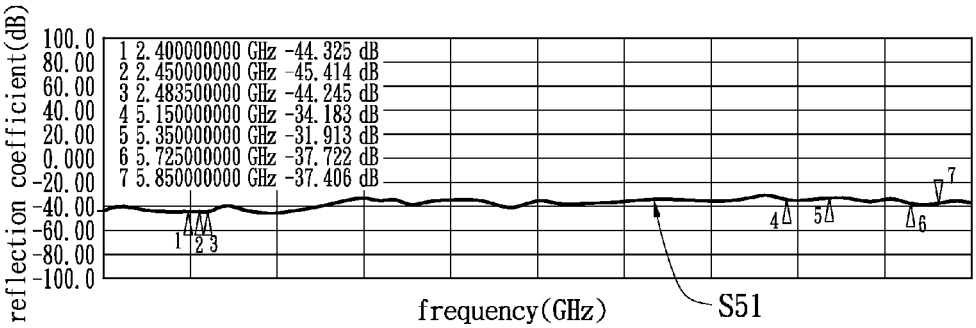
FIG. 1J is a curve diagram of the isolation between the second loop unit and the first radiating unit against frequencies according to the present invention.
Figure 1K:
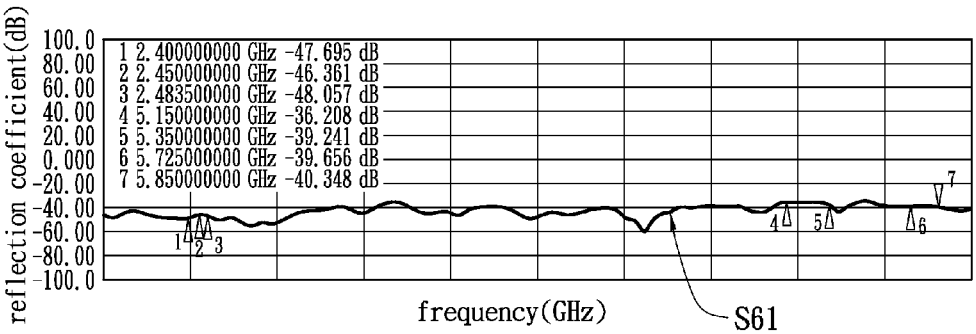
FIG. 1K is a curve diagram of the isolation between the third loop unit and the first radiating unit against frequencies according to the present invention.
Figure 1L:
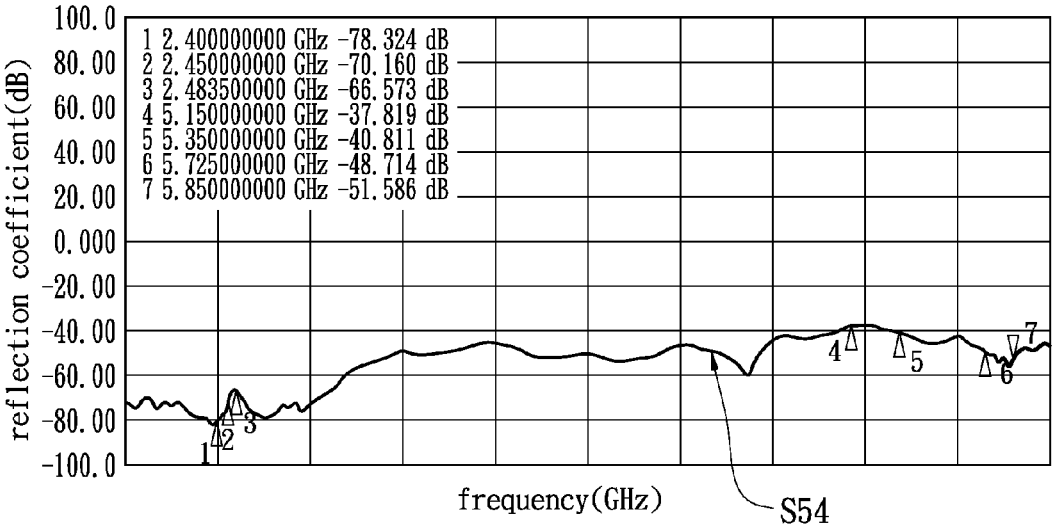
FIG. 1L is a curve diagram of the isolation between the second loop unit and the first loop unit against frequencies according to the present invention.
Figure 1M:
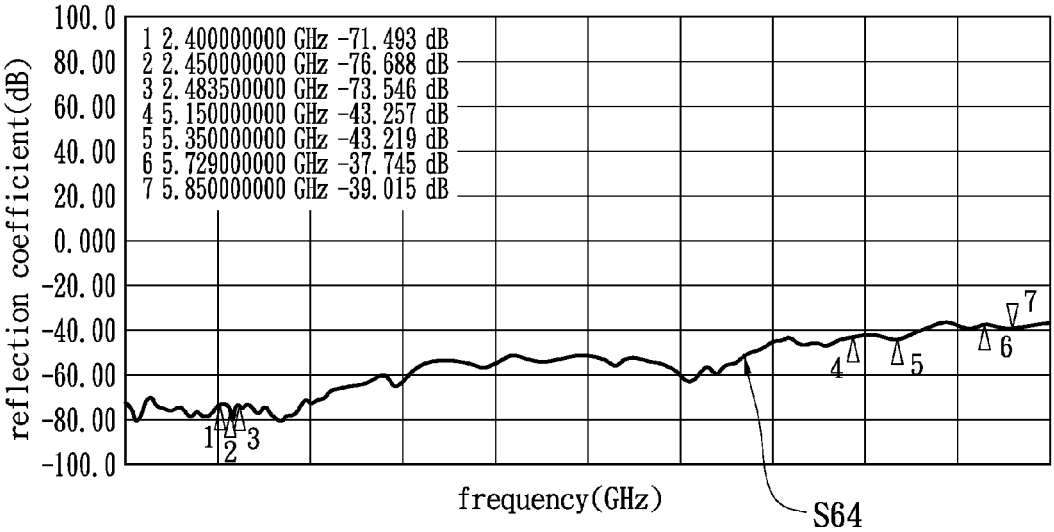
FIG. 1M is a curve diagram of the isolation between the third loop unit and the first loop unit against frequencies according to the present invention.

Referring to FIGS. 1A and 1G to 1M, FIGS. 1G to 1M respectively show the isolation (S parameters (dB)) between any two of the radiating units 2 and the loop units 3 against frequencies (MHz) according to the test results of the radiating units 2 and the loop units 3. The radiating units 2 and the loop units 3 are labeled from S1 to S6. Referring to FIG. 1G, S21 means the isolation between second one and first one of the radiating units 2. Referring to FIG. 1H, S31 means the isolation between third one and first one of the radiating units 2. Referring to FIG. 1I, S41 means the isolation between first one of the loop units 3 and first one of the radiating units 2. Referring to FIG. 1J, S51 means the isolation between second one of the loop units 3 and first one of the radiating units 2. Referring to FIG. 1K, S61 means the isolation between third one of the loop units 3 and first one of the radiating units 2. Referring to FIG. 1L, S54 means the isolation between second one and first one of the loop units 3. Referring to FIG. 1M, S64 means the isolation between third one and first one of the loop units 3. The isolation in 2.4 GHz and 5 GHz bands can be remained under at least −20 dB as shown in FIGS. 1G to 1M. Especially referring to FIGS. 1I to 1K, the isolation in 2.4 GHz band can be remained under at least −45 dB due to the usage of the filter units 4 that can restrain the half-wavelength resonant mode of each loop unit 3.

Figure 1N:
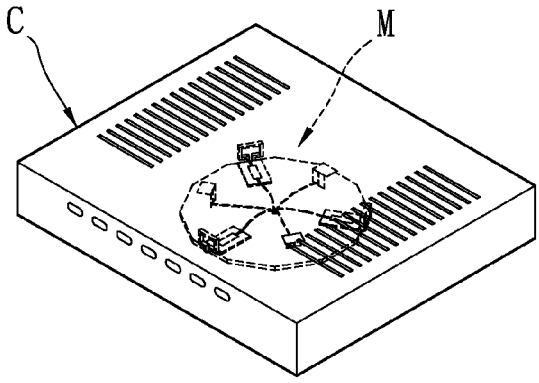
FIG. 1N is a perspective, schematic view of the hybrid multiple-input multiple-output antenna module installed in a wireless device housing according to the first embodiment of the present invention.

Referring to FIG. 1N, the hybrid multiple-input multiple-output antenna module M may be installed in a wireless device housing C that is applied to a wireless communication device (such as router or hub) in order to form a system of the hybrid multiple-input multiple-output antenna module. For example, the hybrid multiple-input multiple-output antenna module M may be installed on the internal side of a top cover of the wireless device housing C. In other words, the grounding unit 1, the radiating units 2, the loop units 3 and the filter units 4 are enclosed by the wireless device housing C. Hence, the hybrid multiple-input multiple-output antenna module M may be hidden in the wireless communication device without need to be placed outside the wireless device housing C in order to enhance the appearance of the wireless communication device that uses hybrid multiple-input multiple-output antenna module M.

Figure 2:
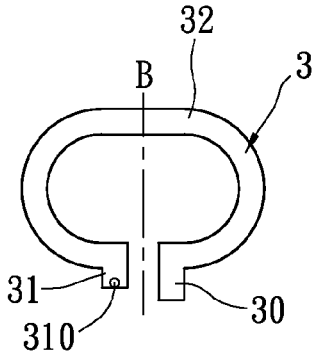
FIG. 2 is a front, schematic view of one loop unit according to the second embodiment of the present invention.

Referring to FIG. 2, the second embodiment of the present invention provides a hybrid multiple-input multiple-output antenna module M, including: a grounding unit 1, a plurality of radiating units 2, a plurality of loop units 3 and a plurality of filter units 4. The difference between the second embodiment and the first embodiment is that: in the second embodiment, the second radiating body 32 of each loop unit 3 is an arc-shaped body connected between each corresponding second shorting pin 30 and each corresponding second feeding pin 31.

Figure 3:
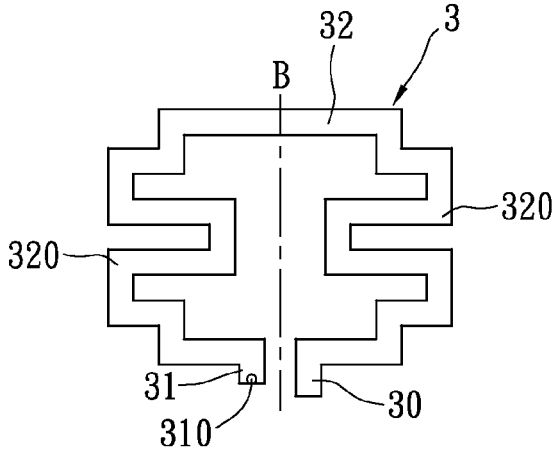
FIG. 3 is a front, schematic view of one loop unit according to the third embodiment of the present invention.

Referring to FIG. 3, the third embodiment of the present invention provides a hybrid multiple-input multiple-output antenna module M, including: a grounding unit 1, a plurality of radiating units 2, a plurality of loop units 3 and a plurality of filter units 4. The difference between the third embodiment and the first embodiment is that: in the third embodiment, the second radiating body 32 of each loop unit 3 has two symmetrical curved portions 320. For example, the two curved portions 320 are symmetric with respect to the geometric centerline B of each loop unit 3. In addition, when the length of radiating body is increased, the resonant path is also increased in order to decrease antenna operating frequencies and size of the hybrid multiple-input multiple-output antenna module M.

Figure 4A:
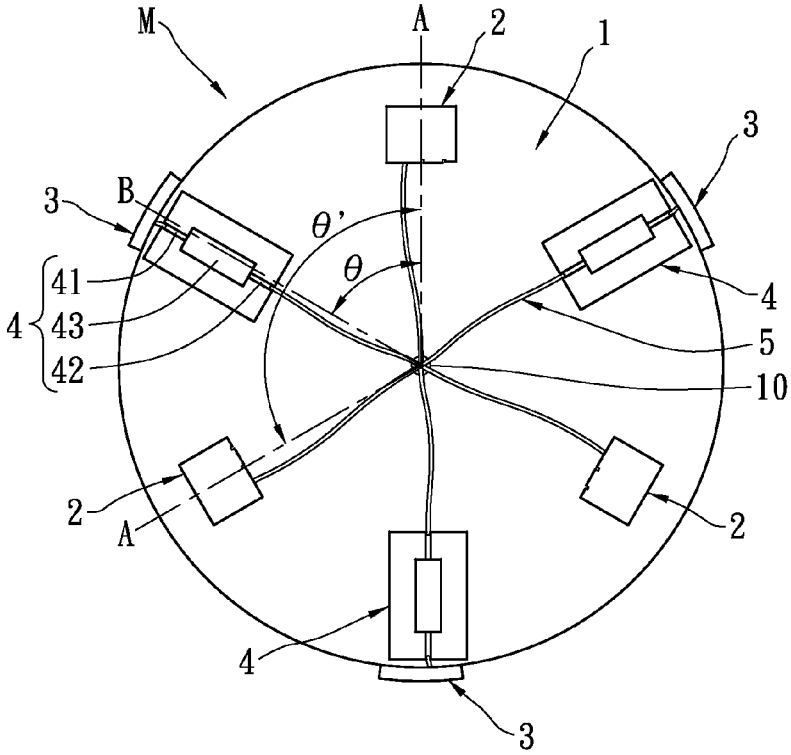
FIG. 4A is a top, schematic view of the fourth embodiment of the present invention.
Figure 4B:
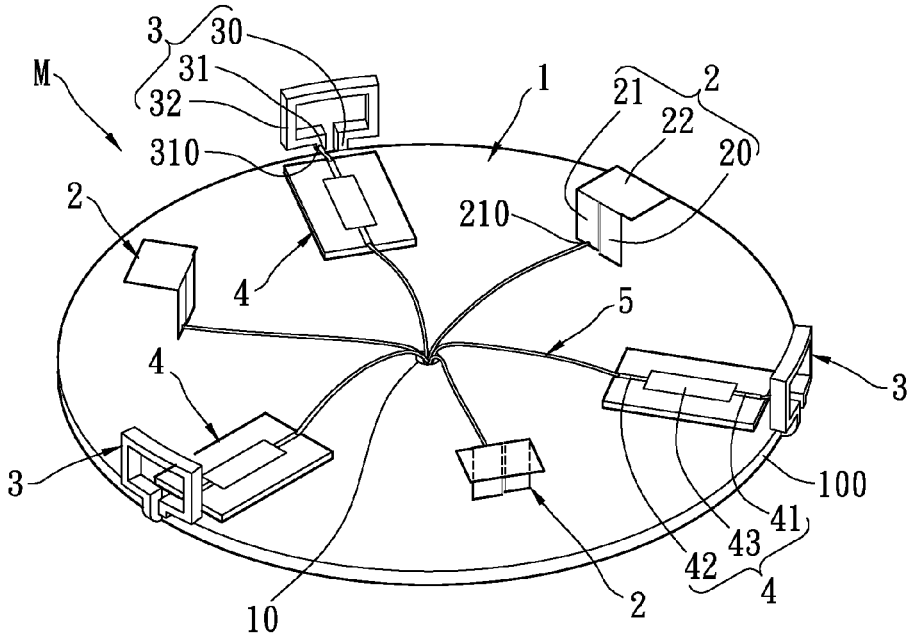
FIG. 4B is a perspective, schematic view of the fourth embodiment of the present invention.

Referring to FIGS. 4A and 4B, the fourth embodiment of the present invention provides a hybrid multiple-input multiple-output antenna module M, including: a grounding unit 1, a plurality of radiating units 2, a plurality of loop units 3 and a plurality of filter units 4. The difference between the fourth embodiment and the first embodiment is that: in the fourth embodiment, the second shorting pin 30, the second feeding pin 31 and the second radiating body 32 of each loop unit 3 are formed on the same curved surface and substantially vertical to the grounding unit 1. The width of each second radiating body 32 is increased in the fourth embodiment in order to increase resonant path without enlarging the size of the hybrid multiple-input multiple-output antenna module M.

In conclusion, the present invention has some advantages according to the above-mentioned examples, as follows:

1. Each radiating unit may be a shorted monopole antenna and each loop unit may be a loop antenna, and thus the present invention can combine different antenna types and different antenna radiation patterns to form the hybrid multiple-input multiple-output antenna module.

2. The present invention uses three independent radiating units (such as three independent short-circuited monopole antennas) for 2.4 GHz operation and three independent loop units (such as three independent loop antennas) for 5 GHz operation in order to achieve concurrent dual-band operation. Hence, the present invention is different from the dual-band single-radio antenna of the related art. For example, the dual-band single-radio antenna of the related art has one RF signal feeding port only, thus the dual-band single-radio antenna of the related art needs to use an extra diplexer to achieve concurrent dual-band operation. Therefore, for the dual-band single-radio antenna of the related art, the cost would be increased and the whole system loses extra gain or power.

3. The whole height of the hybrid multiple-input multiple-output antenna module does not exceed 15 mm in order to achieve the purpose of manufacturing built-in multi-antenna system. In other words, the built-in hybrid multiple-input multiple-output antenna module may be hidden in the access point or router in order to enhance the appearance of the wireless communication device.

4. The hybrid multiple-input multiple-output antenna module can obtain good impedance matching (defined by 2:1 VSWR or 10 dB return loss) for WLAN operation in 2.4 GHz and 5 GHz bands by adjusting (1) the distance between the first shorting pin and the first feeding pin of each radiating unit, (2) the distance between the second shorting pin and the second feeding pin of each loop unit, and (3) the height of each radiating unit and the height of each loop unit relative to the grounding unit.

5. Because the first shorting pin of each radiating unit with one antenna operating frequencies is adjacent to the second feeding pin of each loop unit with another antenna operating frequencies (or the second shorting pin of each loop unit with one antenna operating frequencies is adjacent to the first feeding pin of each radiating unit), the mutual coupling between each radiating unit and each loop unit is substantially decreased and the isolation can be remained under at least −20 dB.

6. Each radiating unit such as a shorted monopole antenna for 2.4 GHz operation can provides inverted conical radiation patterns for the design of access-point antennas applied to the ceiling, and each loop unit may be of a one-wavelength loop structure that is a balanced structure that can substantially mitigate the surface currents excited on the surface of the antenna ground plane or system ground plane. Therefore, the ground plane such as the grounding unit may act as a reflector, thus the directivity of the antenna radiation is large to obtain high antenna gain for compensating high path loss at 5 GHz operating band and to increase communications coverage.

7. The loop units are vertically arranged on the edge (such as the outer peripheral sides) of the grounding unit. Because the antenna radiation patterns are reflected by the grounding unit along two orthogonal directions (one direction is vertical to the grounding unit and horizontal to the radiating units and the loop units, and the other direction is horizontal to the grounding unit), 3-dB half-power beamwidth of each loop unit in the elevation planes can cover wide angle that is more than at least one quadrant on the polar coordinate. Hence, each loop unit has a wide beamwidth radiating patterns.

8. The grounding unit and the loop units may be made of one-piece metal plate by stamping or cutting. Hence, the present invention can effectively decrease manufacturing cost and time.

9. Each filter unit is a 2.4 GHz printed microstrip band-stop filter electrically connected to the second feeding point of each loop unit (such as a 5 GHz loop antenna) for restraining half-wavelength resonant mode of 5 GHz loop antenna, in which the half-wavelength resonant mode of 5 GHz loop antenna is close to 2.4 GHz operating frequency band. Therefore, the isolation at 2.4 GHz operation between 2.4 GHz antenna and 5 GHz antenna would be decreased because the two antennas do not have the overlapped operating frequencies of the nearby resonant modes.

The above-mentioned descriptions merely represent solely the preferred embodiments of the present invention, without any intention or ability to limit the scope of the present invention which is fully described only within the following claims. Various equivalent changes, alterations or modifications based on the claims of present invention are all, consequently, viewed as being embraced by the scope of the present invention.

What is claimed is:

1. A hybrid multiple-input multiple-output antenna module, comprising:

a grounding unit;

a plurality of radiating units arranged on the grounding unit, wherein each radiating unit has a first radiating body parallel to the surface of the grounding unit and extended towards outer peripheral side of the grounding unit, at least one first feeding pin being extended downwards from one side of the first radiating body and being suspended, and at least one first shorting pin being extended downwards from one side of the first radiating body and being connected to the grounding unit, and both the first feeding pin and the first shorting pin and the radiating body are non-coplanar;

a plurality of loop units arranged along the outer peripheral side of the grounding unit and vertically arranged on the grounding unit, wherein each loop unit has at least one second shorting pin connected to the grounding unit, at least one second feeding pin separated from the second shorting pin by a predetermined distance and suspended above the grounding unit at a predetermined distance, and at least one second radiating body vertically suspended above the grounding unit at a predetermined distance and connected between the second shorting pin and the second feeding pin; and a plurality of filter units arranged on the grounding unit and respectively electrically connected to the second feeding pins of the loop units;

wherein the radiating units and the loop units are arranged around a geometric center of the grounding unit and are alternately and symmetrically arranged on the grounding unit.

2. The hybrid multiple-input multiple-output antenna module as claimed in claim 1, further comprising a plurality of signal transmission lines corresponding to the radiating units and the loop units, the signal transmission lines respectively connected to the first feeding pins and the filter units, wherein the grounding unit has a through hole passing through a central portion thereof, and the signal transmission lines pass through the through hole.

3. The hybrid multiple-input multiple-output antenna module as claimed in claim 1, wherein each radiating unit has a geometric centerline and each loop unit has a geometric centerline, and every two adjacent geometric centerlines of the radiating unit and the loop unit intersect at the geometric center of the grounding unit to form an included angle and each of the included angles has substantially the same measure.

4. The hybrid multiple-input multiple-output antenna module as claimed in claim 1, wherein the first feeding pin of each radiating unit is adjacent to the second shorting pin of one adjacent loop unit, and the first shorting pin of each radiating unit is adjacent to the second feeding pin of another adjacent loop unit.

5. The hybrid multiple-input multiple-output antenna module as claimed in claim 1, wherein the second shorting pin and the second feeding pin of each loop unit are symmetrically arranged beside two sides of a geometric centerline of each loop unit, and the second shorting pin, the second feeding pin and the second radiating body of each loop unit are formed on the same plane or curved surface.

6. The hybrid multiple-input multiple-output antenna module as claimed in claim 1, wherein the grounding unit and the loop units are integrally combined to form a one-piece plate structure.

7. The hybrid multiple-input multiple-output antenna module as claimed in claim 1, wherein the second radiating body of each loop unit is an arc-shaped body connected between each corresponding second shorting pin and each corresponding second feeding pin.

8. The hybrid multiple-input multiple-output antenna module as claimed in claim 1, wherein the second radiating body of each loop unit has two symmetrical curved portions, which are symmetric with respect to the geometric centerline of each loop unit.

9. The hybrid multiple-input multiple-output antenna module as claimed in claim 1, wherein the radiating units have one antenna operating frequencies, and the loop units have another antenna operating frequencies.

10. The hybrid multiple-input multiple-output antenna module as claimed in claim 9, wherein the antenna operating frequencies of the radiating unit are less than the antenna operating frequencies of the loop unit.

11. The hybrid multiple-input multiple-output antenna module as claimed in claim 1, wherein each filter unit is a band-stop filter for restraining half-wavelength resonant mode of each loop unit, in which the half-wavelength resonant mode of each loop unit is close to the antenna operating frequencies of each radiating unit.

12. The hybrid multiple-input multiple-output antenna module as claimed in claim 1, wherein each filter unit has a first transmission section, a second transmission section and a microwave printed filter connected between the first transmission section and the second transmission section, and the first transmission section of each filter unit is electrically connected to the second feeding pin of each loop unit and the second transmission section of each filter unit is electrically connected to a corresponding signal transmission line.

13. A hybrid multiple-input multiple-output antenna module installed in a wireless device housing applied to a wireless communication device in order to form a system of the hybrid multiple-input multiple-output antenna module, wherein the hybrid multiple-input multiple-output antenna module comprises:

a grounding unit;

a plurality of radiating units arranged on the grounding unit, wherein each radiating unit has a first radiating body parallel to the surface of the grounding unit and extended towards outer peripheral side of the grounding unit, at least one first feeding pin being extended downwards from one side of the first radiating body and being suspended, and at least one first shorting pin being extended downwards from one side of the first radiating body and being connected to the grounding unit, and both the first feeding pin and the first shorting pin and the radiating body are non-coplanar;

a plurality of loop units arranged along the outer peripheral side of the grounding unit and vertically arranged on the grounding unit, wherein each loop unit has at least one second shorting pin connected to the grounding unit, at least one second feeding pin separated from the second shorting pin by a predetermined distance and suspended above the grounding unit at a predetermined distance, and at least one second radiating body vertically suspended above the grounding unit at a predetermined distance and connected between the second shorting pin and the second feeding pin; and a plurality of filter units arranged on the grounding unit and respectively electrically connected to the second feeding pins of the loop units;

wherein the radiating units and the loop units are arranged around a geometric center of the grounding unit and are alternately and symmetrically arranged on the grounding unit;

wherein the grounding unit, the radiating units, the loop units and the filter units are enclosed by the wireless device housing.

14. The hybrid multiple-input multiple-output antenna module as claimed in claim 13, further comprising a plurality of signal transmission lines corresponding to the radiating units and the loop units, the signal transmission lines respectively connected to the first feeding pins and the filter units, wherein the grounding unit has a through hole passing through a central portion thereof, and the signal transmission lines pass through the through hole.

15. The hybrid multiple-input multiple-output antenna module as claimed in claim 13, wherein each radiating unit has a geometric centerline and each loop unit has a geometric centerline, and every two adjacent geometric centerlines of the radiating unit and the loop unit intersect at the geometric center of the grounding unit to form an included angle and each of the included angles has substantially the same measure.

16. The hybrid multiple-input multiple-output antenna module as claimed in claim 13, wherein the first feeding pin of each radiating unit is adjacent to the second shorting pin of one adjacent loop unit, and the first shorting pin of each radiating unit is adjacent to the second feeding pin of another adjacent loop unit.

17. The hybrid multiple-input multiple-output antenna module as claimed in claim 13, wherein the second shorting pin and the second feeding pin of each loop unit are symmetrically arranged beside two sides of a geometric centerline of each loop unit, and the second shorting pin, the second feeding pin and the second radiating body of each loop unit are formed on the same plane or curved surface.

18. The hybrid multiple-input multiple-output antenna module as claimed in claim 13, wherein the second radiating body of each loop unit is an arc-shaped body connected between each corresponding second shorting pin and each corresponding second feeding pin.

19. The hybrid multiple-input multiple-output antenna module as claimed in claim 13, wherein the second radiating body of each loop unit has two symmetrical curved portions, which are symmetric with respect to the geometric centerline of each loop unit.

20. The hybrid multiple-input multiple-output antenna module as claimed in claim 13, wherein each filter unit is a band-stop filter for restraining half-wavelength resonant mode of each loop unit, in which the half-wavelength resonant mode of each loop unit is close to the antenna operating frequencies of each radiating unit.

* * * * *